United States Patent [19]

Derichs et al.

[11] 4,327,546

[45] May 4, 1982

[54] METHOD AND APPARATUS FOR JOINING A THREAD

[75] Inventors: Josef Derichs; Hans Raasch, both of Mönchen-Gladbach, Fed. Rep. of Germany

[73] Assignee: W. Schlafhorst & Co., Mönchen-Gladbach, Fed. Rep. of Germany

[21] Appl. No.: 95,348

[22] Filed: Nov. 19, 1979

[30] Foreign Application Priority Data

Nov. 23, 1978 [DE] Fed. Rep. of Germany ..... 2850729

[51] Int. Cl.[3] ..... D01H 15/02

[52] U.S. Cl. ..... 57/263

[58] Field of Search ..... 57/261–263

[56] References Cited

U.S. PATENT DOCUMENTS 4,041,684 8/1977 Kamp ..... 57/263

4,107,957 8/1978 Stahlecker et al. ..... 57/263

4,120,140 10/1978 Raasch et al. ..... 57/263

4,145,867 3/1979 Kamp ..... 57/263

4,175,370 11/1979 Stahlecker ..... 57/263

*Primary Examiner*—John Petrakes

*Attorney, Agent, or Firm*—Herbert L. Lerner

[57] ABSTRACT

Method and apparatus for joining a thread returned by a traveling joining device from a take-up coil to a spinner rotor of an open-end rotor spinning machine station, including a thread joining device being disposed on the joining device and being shiftable into reverse motion for returning the thread to the spinner rotor, a thread pulling device disposed on the joining device, a thread support disposed on the spinning station, a device for transferring thread after joining from the thread pulling device to the thread support, and a thread accumulator insertable into the path of the thread between the thread pulling device and the take-up coil.

7 Claims, 6 Drawing Figures

METHOD AND APPARATUS FOR JOINING A THREAD

The invention relates to a method and apparatus for joining a thread which is fed from a take-up coil to the spinner rotor of the spinning station of an open-end rotor spinning machine by means of a travelling joining device. The thread is returned from the take-up coil to the spinner rotor by shifting the thread-pulling device of the joining device into reverse; the thread-pulling device of the joining device is shifted into forward gear at the instant of joining; the thread is taken from the thread pulling device of the joining device by a thread transfer device; and the thread is transfered to the thread guide of the spinning station.

For the purpose of joining, the traveling joining device has a separate thread-pulling device. The thread is deflected and pulled back from a normal running direction in such a manner that it is conducted around the pulling-off cylinder of the joining device and is brought back from there to the pull-off tube of the spinner rotor. After the joining operation, the pull-off cylinder of the joining device is switched from reverse to forward motion. The thread is then pulled off with constant, normal, pulling-off velocity. If the thread is then to be transferred to the normal thread support of the spinning station, an additional length of thread becomes free.

If the take-up coil is a conical cross-wound coil, difficulties are encountered in the joining process because the circumferential speed of the pulling-off cylinder cannot be synchronized per se with the thread take-up velocity or the thread-pull-off velocity at the take-up coil. If, for instance, the circumferential speed of the cross-wound coil is somewhat too low when the thread is returned to the spinner rotor, the thread breaks, and if the circumferential speed is too high, the thread loses its tension between the pulling-off cylinder and the cross-wound coil and forms curls which lead to a failure of the joining operation.

It is accordingly an object of the invention to provide a method and apparatus for joining a thread which overcomes the hereinafore mentioned disadvantages of the heretofore known devices of this general type, and to achieve the joining of a thread returned to the spinner rotor without enlargment or weakening, with uniform thread tension and without disturbance of the winding process, even in the case where a conical coil and in particular, a conical cross-wound coil, is used as the take-up coil.

With the foregoing and other objects in view there is provided, in accordance with the invention, a method for joining a thread returned by a traveling joining device from a take-up coil to a spinner rotor of an open-end rotor spinning machine station, which comprises shifting a thread pulling device of the joining device into reverse motion, inserting a thread accumulator into the path of the thread between the thread pulling device and the take-up coil, shifting the thread pulling device into forward motion at the instant of joining, taking the thread from the pulling device with a thread transfer device, and transferring the thread to a thread guide of the spinning station.

In accordance with another mode of the invention, there is provided a method which includes partially filling the thread accumulator with thread before placing the clamping roll of the thread pulling device on the pull-off cylinder of the thread pulling device, and emptying the thread accumulator of thread immediately before transferring the thread from the joining device of the spinning station.

In accordance with the device of the invention, there is provided an apparatus for joining a thread returned by a traveling joining device from a take-up coil to a spinner rotor of an open-end rotor spinning machine station, comprising thread joining means being disposed on the joining device and being shiftable into reverse motion for returning the thread to the spinner rotor, thread pulling means disposed on the joining device, a thread support disposed on the spinning station, means for transferring thread after joining from the thread pulling means to the thread support, and a thread accumulator insertable into the path of the thread between the thread pulling means and the take-up coil.

In accordance with a further feature of the invention, there are provided means at least partially disposed on the thread accumulator for adjusting the fullness of the thread.

In accordance with an added feature of the invention, the fullness adjusting means includes a sensor or a switch for sensing the fullness of the thread.

In accordance with an additional feature of the invention, the thread accumulator comprises a controllable loop puller.

In accordance with a concomitant feature of the invention, the thread accumulator includes a thread suction device.

The advantages achieved with the invention are in particular that perfect joints are obtained, even for conical take-up coils, and the number of thread breaks and unsuccessful joining attempts is reduced.

Other features which are considered as characteristic for the invention are set forth in the appended claims.

Although the invention is illustrated and described herein as embodied in method and apparatus for joining a thread, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
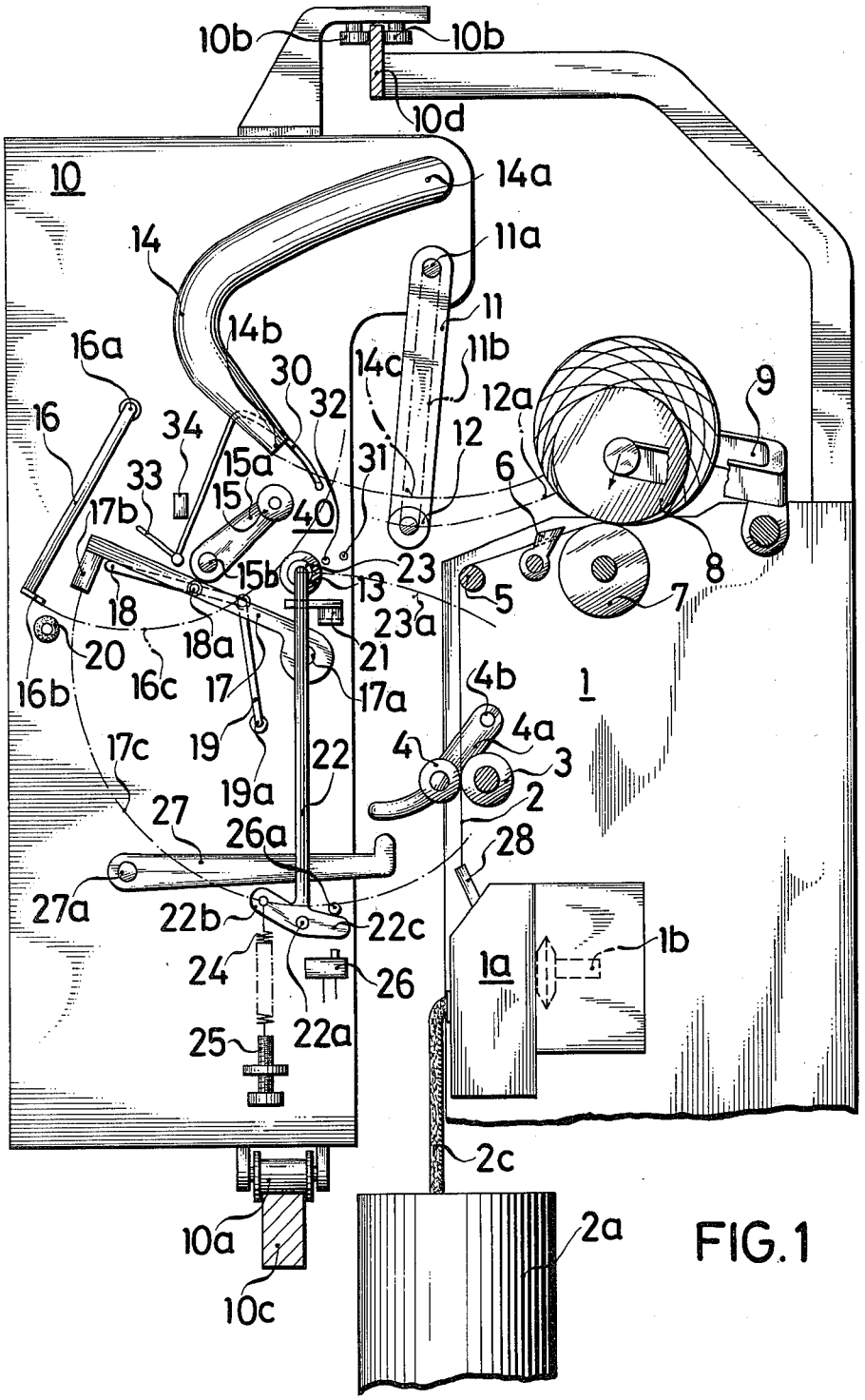
FIG. 1 is a diagrammatic side elevational view of a spinning station and a joining device according to the invention.

Referring now to the figures of the drawing and first, particularly, to FIG. 1 thereof, there is seen a spinning station 1 which comprises a rotor spinning device 1*a* with a spinner rotor 1*b*.

In normal operation, the spun thread 2 is brought through a thread pull-off device which includes a pulling-off cylinder 3 and a clamping roller 4. The thread 2 is pulled with constant velocity out of the rotor spinning device 1*a* by the thread-pulling device. From the pulling-off cylinder 3, the thread 2 runs over a deflection bar 5, through the thread guide 6 and over a winding cylinder 7 to a conical take-up coil 8. The conical take-up coil 8 is driven with constant speed by the winding cylinder through friction. The conical take-up coil 8 is supported in a coil frame 9.

Figure 2:
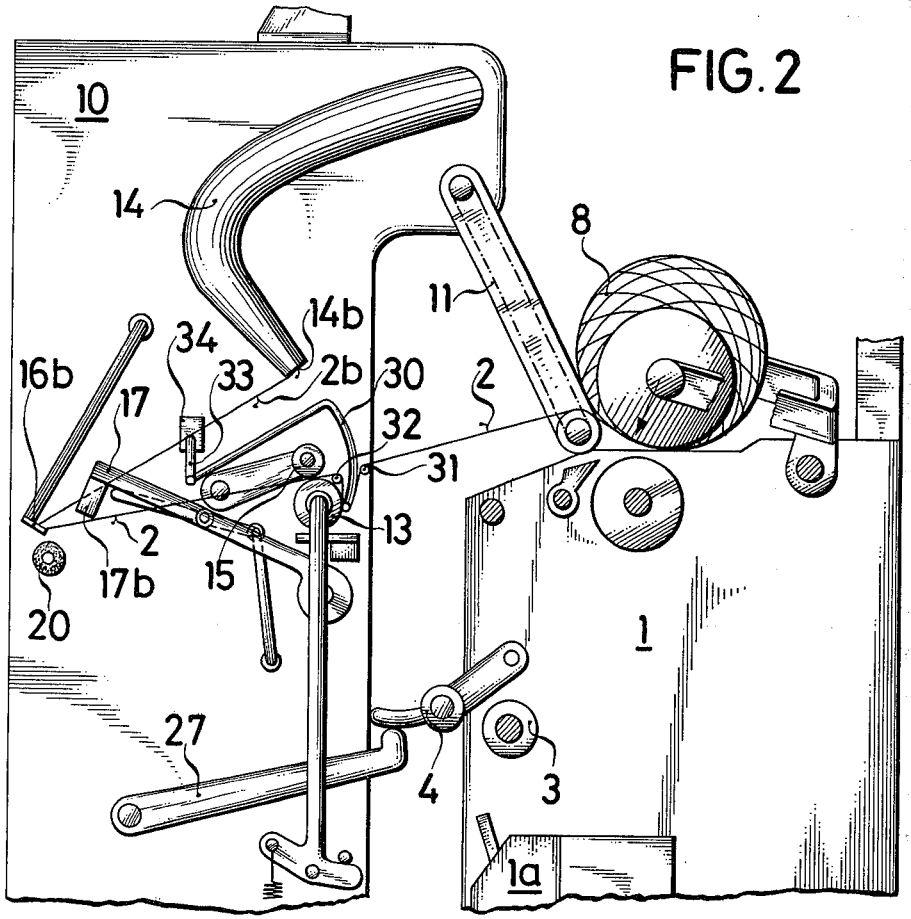
FIGS. 2 and 3 are views of the same spinning station and the same joining device shown in FIG. 2, at different points in time in the joining process.

In front of the spinning station 1, to the left in FIG. 2, there is seen a joining device 10 which can be moved by means of rolls 10*a*, 10*b* on tracks 10*c*, 10*d*. The joining device 10 has a drive arm 11 which can be swung about a pivot 11*a*. The drive roll 12, which is rotatably supported at the end of the drive arm 11 and can be driven by a chain drive 11*b*, can be swung along a circular arc 12*a*. The drive roll 12 can be driven by means of the chain drive 11*b* in both directions of rotation.

At the joining device 10, there is also seen a further thread-pulling device including a pulling-off cylinder 13 and a clamping roll 15. The clamping roll 15 is mounted at the end of a lever 15*a* which is pivoted about a fulcrum 15*b*. The drive roll 12 and the pulling-off cylinder 13 can be synchronously driven with the same circumferential speed.

A suction tube 14 is rotatably suspended at the pivot 14*a*, so that its suction nozzle 14*b* can swing along the circular arc 14*c*. A thread puller 16 is swingable about the pivot 16*a*. Its thread gripper 16*b* describes a circular arc 16*c* when the thread puller 16 is swung.

A grinding wheel 20 serves for treating the thread to be returned, as will be explained in greater detail hereinbelow. Furthermore, there is seen a thread feed 17 which is pivoted about a fulcrum 17*a* and to which a thread lifter 18 is fastened, at the pivot 18*a*. The thread lifter 18 is controlled by a linkage 19 fastened in an articulating manner. The link 19 is connected to the housing of the joining device 10 at a pivot 19*a*. The clamp 17*b* of the thread feed 17 can swing along the circular arc 17*c*.

Below the pulling-off cylinder 13 can be seen an ejector 21, which can be shifted perpendicularly to the plane of the drawing. The ejector 21 serves to throw a thread located on the pulling-off cylinder 13 onto the roll 23 of a thread transfer device 22 at a given time. This is shown in larger scale in FIG. 5. The thread transfer device 22 can be swung about the pivot 22*a*. The thread transfer device 22 has a lever 22*c*, into which one end of a return spring 24 is hooked. The other end of the return spring 24 is flexibly fastened to an adjusting screw 25. The spring force can be set by means of the adjusting screw 25. The roll 23 of the thread transfer device 22 can swing along the circular arc 23*a*. If the thread transfer device 22 swings into the other end position from that shown in FIG. 1, i.e. to the right, the effective lever arm force of the lever 22*b* is changed, so that the effect of the return spring 24 on the thread transfer device 22 becomes less. As soon as the thread transfer device reaches the other end position, the other lever 22*c* actuates a switch 26.

A stop pin 26*a* prevents the thread transfer device 22 from swinging back too far to the left in FIG. 1 under the action of the return spring 24. It can be seen from FIG. 4 that the pivot 22*a* is set at an angle, so that the roll 23 can swing in the direction of the arrow 23*b* under the coil end 8*a* of the take-up coil 8.

In FIG. 1 there is shown the placement of a mechanical thread accumulator 40 which includes the following parts: In front of the pulling-off cylinder 13, deflection pins 31 and 32 are disposed. An accumulator arm 30 is operable to scan between the pins 31,32. The elements 30, 31 and 32 form a controllable loop puller. At the support point of the accumulator arm 30, there is disposed a switching vane 33 which can actuate a switch 34. These elements 33 and 34 form a fullness-setting or length sensing device. The arm 30 moves between the pins 31, 32 because of its own weight and forms a loop. The vane 33 approaches the switch 34 when the loop is at a maximum. The switch 34 is connected to a conventional program timer of the joining device 10, which is not shown in detail. If the desired amount of fullness or length is reached, the switch 34 is automatically closed and the joining program continues according to the control diagram of FIG. 6. In the rest position of the joining device 10, the accumulator arm 30 is held in the position shown by a non-illustrated cam control, i.e. it is lifted from the deflection pins 31 and 32.

Referring to the motion and control program shown in FIG. 6 and the drawings of FIGS. 1 to 5, the joining operation will now be explained in detail. In FIG. 6 are plotted the time t on the abscissa, and on the ordinate the motion and control of the parts 4, 11 to 17, 21, 22 and 30, which are to be controlled, for example, in accordance with a sequence control plan.

FIG. 1 shows the location of all parts in undisturbed spinning operation. From a can 2*a*, sliver 2*c* is fed to the rotor spinning device 1*a*. In the rotor 1*b*, the thread 2 is produced, and then the thread is brought through the pull-off tube 28 and is pulled off with constant velocity through the pulling-off device 3,4. A lifter 27 which is pivoted at 27*a* is shown in the rest position. The lifter 27 serves for lifting the clamping roll 4 that is fastened to a lever 4*a* and is pivoted at 4*b*. In the event of an interruption of the operation which requires renewed joining, the position of the elements is the same as shown in FIG. 1, with the difference that the thread 2 is missing and the thread end has been wound on the take-up coil 8. The supply of sliver 2*c* is still shut off.

Upon a starting command for joining, which according to FIG. 6 is given at the instant of time A, the drive arm 11 swings toward the conical take-up coil 8. Then, at time B, the suction arm 14 also begins to swing toward the conical take-up coil 8. As soon as the drive arm 11 has reached the take-up coil at time C, its drive roller 12 begins to rotate backwards. The drive arm 11 then lifts the conical take-up coil 8 off the winding cylinder 7 and turns it against the winding direction. At the same instant, the pulling-off cylinder 13 also is switched into reverse. At the time D, the suction arm 14 has approached the conical take-up coil far enough so that the suction nozzle 14*b* is very close to the coil surface. Up to the time E, the thread is located on the coil surface and sucked up through the suction nozzle 14*b*. When this is done, the suction arm 14 swings back again until time F and takes the thread 2 along in the process. At the same instant, the drive roll 12 and the pulling-off cylinder 13 are switched off. The pulling-off cylinder 13 had not yet made any contact with the thread up to that point, and was running only because it is switched on and off synchronously with the drive roll 12.

From time F to time G, the thread puller 16 swings upward, grips the thread 2 which is partially sucked into the nozzle 14*b*, and swings back again, and pulls out the thread loop shown in FIG. 2. The thread 2 now leads from the conical take-up coil 8 between the clamping roll 15 and the pulling-off cylinder 13 of the thread-pulling device to the thread gripper 16*b*. From there, the thread end 2*b* extends into the suction nozzle 14*b*.

At time H, the clamping roll 15 is swung against the pulling-off cylinder 13 and the thread feed is set in motion. Simultaneously, the clamping roll 4 is lifted off the pulling-off cylinder 3 by actuation of the lifter 27, as is shown in FIG. 2.

At time I, the thread 2 is clamped between the stopped pulling-off cylinder 13 and the clamping roll 15. The thread-pulling device 3, 4 is now fully open. The thread feed 17 in the meantime has been swung downward a small distance, and specifically far enough so that the clamp 17*b* is located in front of the grinding wheel 20. The grinding wheel 20 cuts the thread and prepares the new thread end for joining by unraveling and pointing. The old thread end 2*a'* which is shown in FIG. 3 is sucked up by the suction nozzle 14*b* and is removed.

At time J, the drive roll 12 and the pulling-off cylinder 13 are shifted into slow reverse. At the same time, the thread feed 17 begins to swing further down on the circular path 17*c*. At time K, this swing movement is completed, as is evident from FIG. 3.

Figure 3:
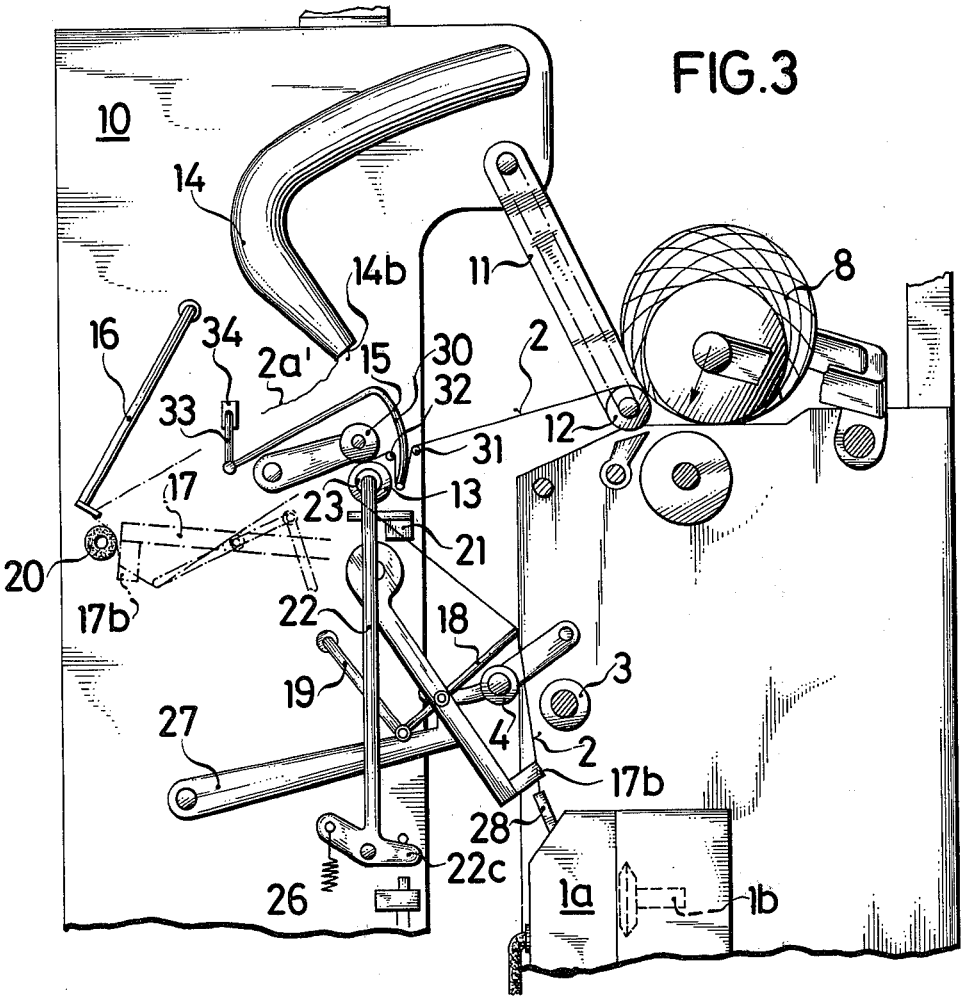

FIG. 3 shows the joining device at the time when the thread has been introduced into the pull-off or draw-off tube 28. During the return of the thread into the rotor 1*b*, the accumulator arm 30 gives off thread length or takes up additional thread length, depending on the instantaneous pulling-off velocity since the arm 30 forms a loop between the pins 31, 32 because of its own weight and a greater velocity will raise the arm and lessen the loop. The maximum storage capacity is adjusted so that the commonly occurring differences can be compensated. When the vane 33 reaches the switch 34 the loop is at a maximum and the switch 34 signals the continuation of the joining operation.

The clamp 17*b* of the thread feed 17 stands in front of the opening of the pull-off tube 28 of the rotor spinning device 1*a*, in the position according to FIG. 3. Controlled by the linkage 19, the thread lifter 18 has in the meantime been positioned transversely to the thread feed 17 and in the process has placed the thread 2 into the open thread pulling-off device 3, 4 of the spinning station. At time K, the clamp 17*b* opens. Simultaneously the new thread end formed by the grinder 20 is sucked into the pull-off tube 28. At the same instant, the drive roll 12 and the pulling-off cylinder 13 are shifted into a somewhat faster reverse gear.

At time L, the thread end has almost reached the rotor groove of the spinner rotor 1*b*. The drive roll 12 and the pulling-off cylinder 13 are stopped between the times L and M so as to feed back a remaining section of thread into the spinner rotor 1*b* immediately after the times M and N, so that the joining proper takes place. At the time N, the direction of rotation of the drive roll 12 and the pulling-off cylinder 13 is reversed and is thereupon increased with a rapid start-up to a predetermined operating speed of the thread withdrawal. At time O, the thread feed 17 begins to swing back. This motion is ended at the time P. At the same instant, the operating speed of the thread pull-off is also reached; this means that the pull-off cylinders 3 and 13 have the same circumferential velocity. The pulling-off cylinder 3 rotates continuously with the normal thread pull-off speed.

Figure 4:
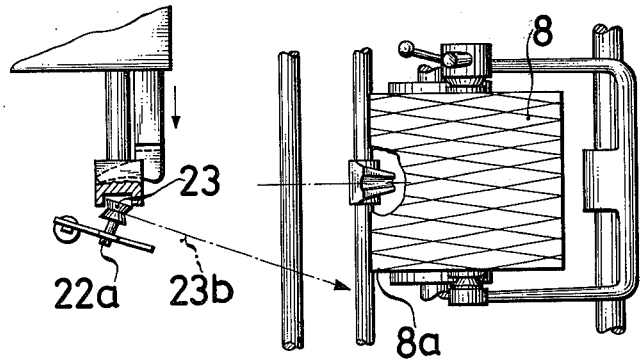
FIG. 4 is a fragmentary top plan view of the spinning station and the joining device of FIG. 1.

Between the times P and Q, the lifter 27 is taken back again, so that the clamping roll 4 bears against the pulling-off cylinder 3. The transfer of the thread 2 to the thread guide 6 can now take place. For this purpose, the clamping roll 15 is first lifted off the pulling-off cylinder 13 at time Q and the ejector 21 is set in operation. The ejector 21 pushes the thread 2 laterally downward from the pulling-off cylinder 13, so that it slides onto the roll 23 of the thread transfer device 22. When this has taken place at time R, the thread transfer device 22 begins to swing at an angle in the direction toward the spinning station 1. This motion ends at time S. Between times R and S, the drive roll 12 and the pulling-off cylinder 13 are shifted to fast forward. This is necessary to enable the take-up coil 8 to take up the additional thread length out of the thread accumulator 40. This thread length becomes free due to the swinging of the thread transfer device 22, with the thread tension unchanged or slightly increased. The content of the thread accumulator decreases. The deflection pins 31 and 32 are disposed so that the thread can slide off laterally when the accumulator is almost empty. The pulling-off cylinder 13 now no longer has a real function; it idles along only because it is driven synchronously with the drive roll 12 for the sake of simplicity. The thread transfer device 22 is swung in this case under the action of the thread tension against the force of the adjustable return spring 24. The return spring 24 is hung in such a way that the force component acting in the excursion or moving direction gets smaller with increasing excursion or movement out of the rest position of the thread transfer device 22. This is advantageous because the loop angle of the thread, and therefore also the effective force component of the thread tension, also become smaller with increasing excursion or movement. In the end position of the thread transfer device 22, the lever 22*c* actuates the switch 26 at time S. The switch 26 switches the drive roll 12 and the pulling-off cylinder 13 back to the normal thread-pull-off velocity. Since the thread transfer device 22 deflects the thread 2 at an angle under the coil end 8*a* as shown in FIG. 4, it first slides off laterally from the drive roll 12, is seized at time S by the thread guide 6 and is then pulled off laterally from the roll 23 of the thread transfer device 22.

After the thread transfer is completed, the thread transfer device 22 swings back into its starting position under the action of the return spring 24. When this has happened, at the time T, the drive arm 11 also begins to swing back. During the swinging motion of the drive arm 11 and after the take-up coil 8 again rests on the winding cylinder 7, at time U the drive roll 12 and the pulling-off cylinder 13 are switched off. As soon as the drive arm 11 has reached its rest position at time V which is shown in FIG. 1, the control program is completed.

The program timer is contained in the joining device 10 and is not shown in detail. This may be, for instance, a conventional electromechanical program timer working with cams.

Figure 5:
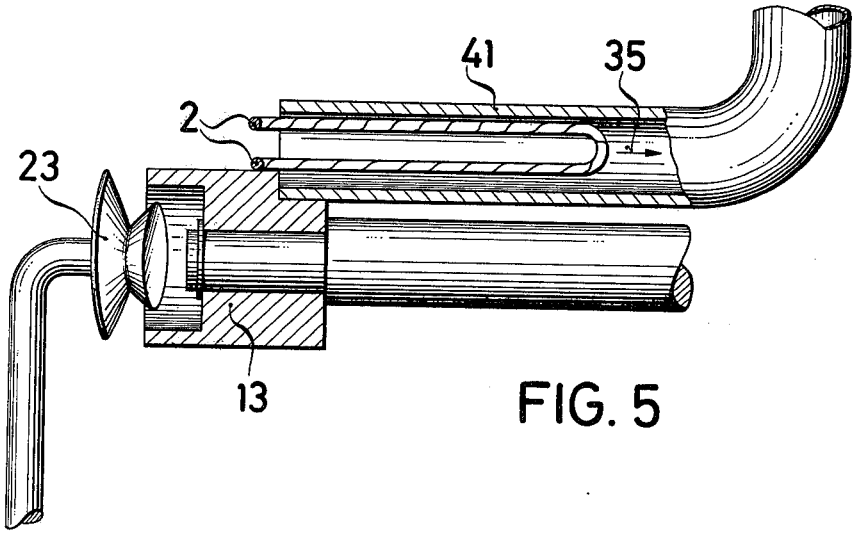
FIG. 5 is a partially cross-sectional view of a pulling-off cylinder and a thread accumulator.
Figure 6:
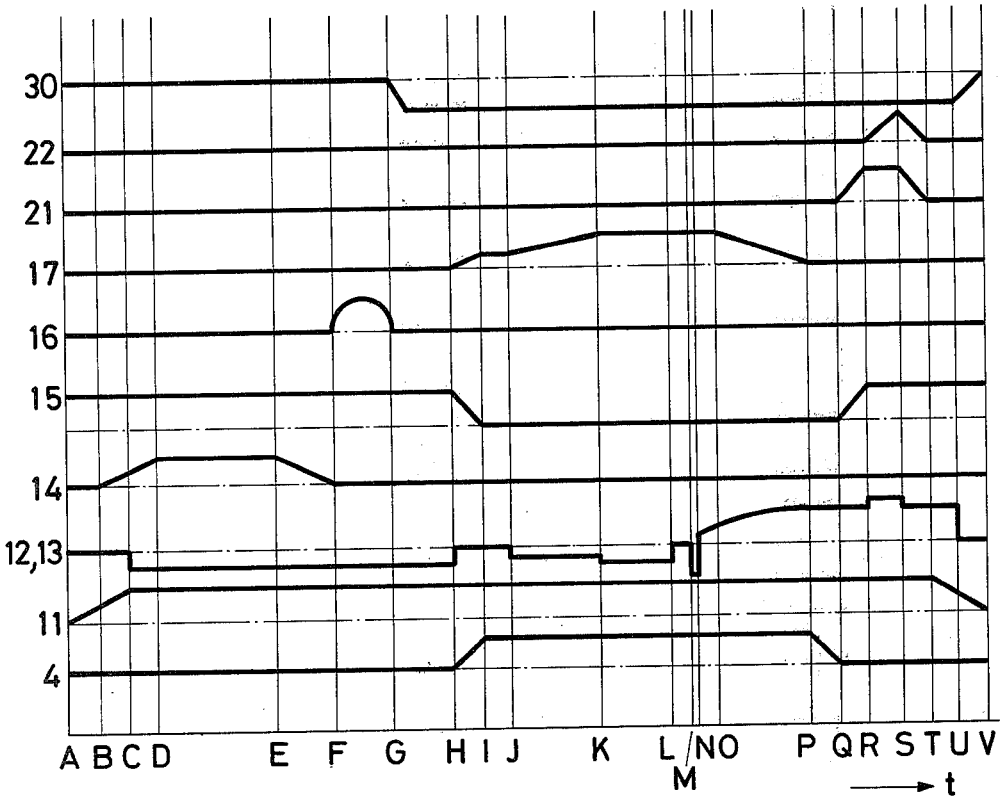
FIG. 6 is a motion and control diagram.

As an alternative, a thread accumulator 41 is shown in FIG. 5. The thread accumulator 41 includes a tube through which air flows in the direction of the arrow 35. This tube forms a thread suction device and is disposed in front of the pulling-off cylinder 13 to perform the function of the accumulator 30. The suction in the accumulator 41 is just strong enough to form a loop the size of the loop produced by the weight of the arm 30 in the accumulator 40.

There is claimed:

1. Method for joining a thread returned by a traveling joining device from a take-up coil to a spinner rotor of an open-end rotor spinning machine station including a thread pulling device of the joining device being shiftable in forward direction for moving the thread toward the take-up coil and in reverse direction for moving the thread toward the rotor, a thread accumulator and a thread transfer device, which comprises shifting the thread pulling device of the joining device into reverse motion, inserting the thread accumulator into the path of the thread between the thread pulling device and the take-up coil, subsequently shifting the thread pulling device into forward motion at the instant of joining, taking the thread from the pulling device with the thread transfer device, and transferring the thread to a thread guide of the spinning station.

2. Method according to claim 1, wherein said thread-pulling device includes a clamping roll and a pull-off cylinder, which comprises partially filling the thread accumulator with thread before placing the clamping roll of the thread pulling device on the pull-off cylinder of the thread pulling device, and emptying the thread accumulator of thread immediately before transferring the thread from the joining device to the spinning station.

3. Apparatus for carrying out the method of joining a thread returned by a traveling joining device from a take-up coil to a spinner rotor of an open-end rotor spinning machine station, comprising thread pulling means being disposed on said joining device and being shiftable into reverse motion for returning the thread to the spinner rotor, a thread support disposed on the spinning station, means for transferring thread after joining from said thread pulling means to said thread support, and a thread accumulator insertable into the path of the thread between said thread pulling means and the take-up coil forming a thread loop before joining.

4. Apparatus according to claim 3, including means at least partially disposed on said thread accumulator for sensing the length of the thread loop.

5. Apparatus according to claim 4, wherein said length sensing means includes a sensor for sensing the length of the thread.

6. Apparatus according to claim 5, wherein said sensor is a switch.

7. Apparatus according to claim 3 or 4, wherein said thread accumulator comprises a controllable loop puller.

* * * * *